US005203251A

United States Patent [19]

Karlberg

[11] Patent Number: 5,203,251

[45] Date of Patent: Apr. 20, 1993

[54] MOTOR WITH SPRING ELEMENTS FORMED ON VALVE ASSEMBLY

[75] Inventor: Leif Karlberg, Älta, Sweden

[73] Assignee: Alentec Orion Aktiebolag, Sweden

[21] Appl. No.: 781,113

[22] Filed: Oct. 22, 1991

[30] Foreign Application Priority Data

Oct. 31, 1990 [SE] Sweden ..... 9003472

[51] Int. Cl.[5] ..... F01L 15/12; F15B 15/17

[52] U.S. Cl. ..... 91/224; 91/229; 91/235; 91/417 R; 91/422

[58] Field of Search ..... 91/222, 224, 229, 422

[56] References Cited

U.S. PATENT DOCUMENTS

| | | | |
|---|---|---|---|
| 2,091,390 | 8/1937 | Forman | 91/224 |
| 2,987,051 | 6/1961 | Goyette et al. | 91/229 X |
| 3,094,938 | 6/1963 | Blomeke et al. | 91/224 X |
| 3,654,834 | 4/1972 | Sifri et al. | 91/422 X |
| 4,879,943 | 11/1989 | Grach | 91/224 |
| 4,895,305 | 1/1990 | Powell | 91/224 X |

*Primary Examiner*—Edward K. Look
*Assistant Examiner*—John Ryznic
*Attorney, Agent, or Firm*—Robert G. Mentag

[57] ABSTRACT

The present invention relates to a valve assembly (10) which is mounted on a part (piston unit 40) of an air motor (10) arranged for reciprocating movement in a housing (cylinder 12). The valve assembly includes a first valve unit (50), which is mounted on one side of the part (40), and a second valve unit (70), which is mounted on the other side of the part (40). The second valve unit is connected to the first valve unit (50) by means of the part (40) for common movement with the first valve unit relative to the part (40) when the valve assembly is switched as the part (40) reaches one of its two end turning-positions. In order to enable the valve assembly to be switched instantaneously and to eliminate the risk that switching the assembly will not take place, particularly when the motor is operated at a low speed, it is proposed in accordance with the invention, among other things, that each of the valve units (50 and 70 respectively) is produced from an elastomeric material and is provided with integrally formed spring elements (52 and 72 respectively) which will strike against solid abutments (18, 22) in the housing (12) upon mechanical switching of the valve assembly.

5 Claims, 2 Drawing Sheets

MOTOR WITH SPRING ELEMENTS FORMED ON VALVE ASSEMBLY

The present invention relates to a valve assembly which is mounted on a part of an air motor which is driven reciprocally in a housing and which includes a first valve unit mounted on one side of said air motor part and a second valve unit mounted on the other side of said part, said second valve unit being connected to said first valve unit through the medium of said part for common movement with said first unit in relation to said air motor part when the valve assembly is switched mechanically at one of the reversing or end-turning positions of said motor.

When used with a piston-cylinder type air motor, the mechanical switching of this known valve assembly at the two movement-reversing positions (i.e. top and bottom dead centre positions) of the piston is effected by means of a pair of coil springs that are mounted on the piston rod, adjacent a cylinder end wall. One drawback with this arrangement is that switching or resetting of the valve assembly takes place relatively slowly, due to the low spring constant and to the extensive spring length that is required in order to ensure that the valve assembly will not be subjected to excessively large impact forces at the piston turning positions. Furthermore, because efficient functioning of the valve bodies in the valve assembly and the valve seats are highly sensitive to centering and alignment errors, there is a danger that the valve assembly will not be switched and that the piston will stop in a positions of equilibrium, particularly when the motor is driven slowly or subjected to an external load which acts in a direction towards one of the piston turning positions.

An object of the present invention is to provide a valve assembly of the aforesaid kind in which the valve assembly will always be switched instantaneously, irrespective of the speed at which the piston moves and irrespective of the influence of external loads.

This object is achieved with the inventive valve assemb in the following Claims.

Because each of the valve units is manufactured from an elastomeric material and has integrally formed therewith spring elements which are intended to engage fixed abutments in the housing when mechanical switching of the valve assembly takes place, it is possible to utilize the intrinsic damping properties and spring properties of the plastic material to reset the valve units in a much shorter engagement path than was previously the case.

When, in accordance with a further feature of the invention, the valve units are provided with valve bodies in the form of lip seals which are formed integrally with said valve units and from mutually the same material, and which are intended to coact directly with the planar sides of the reciprocatingly moveable part, a good sealing function is obtained while, at the same time, enabling the valve guides to be made of simpler construction than was previously the case.

Figure 1:
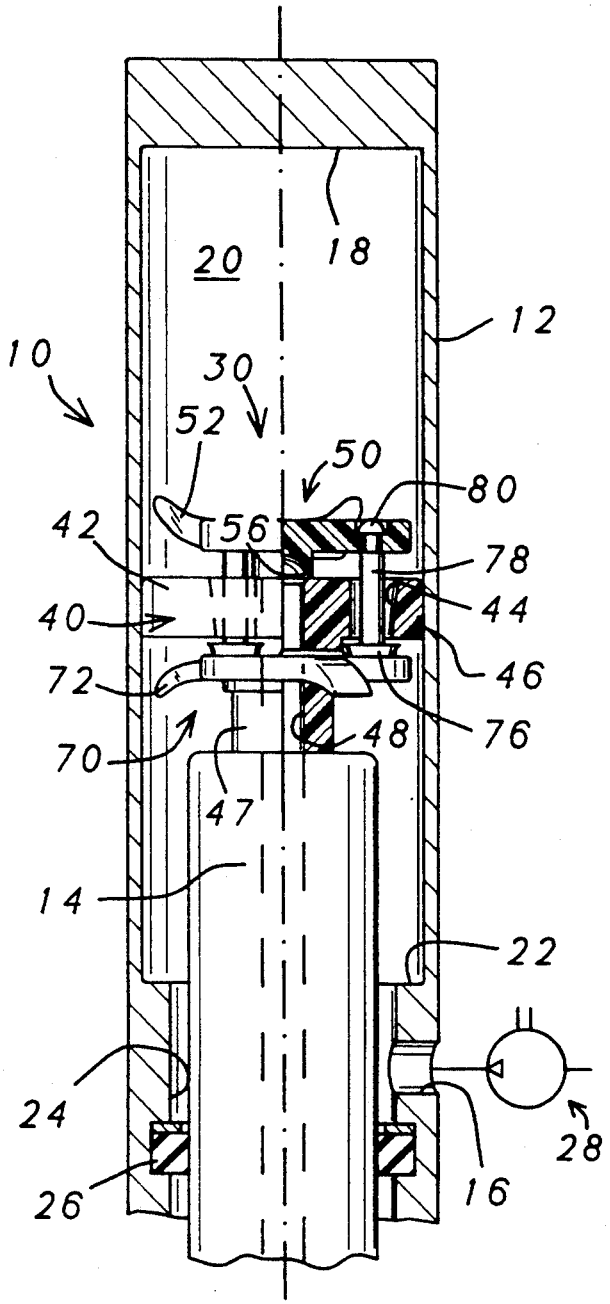
Figure 2:
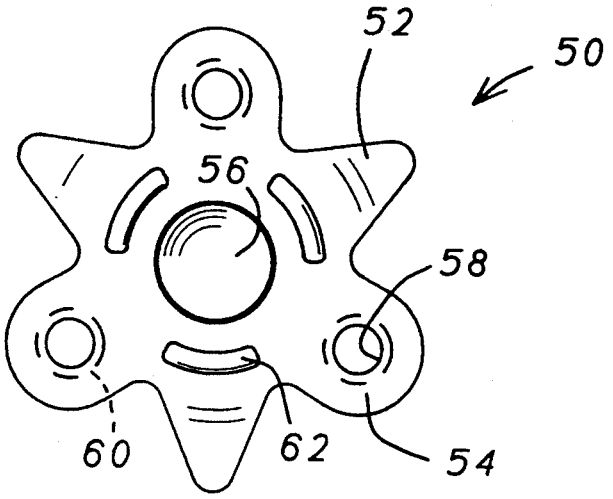
Figure 3:
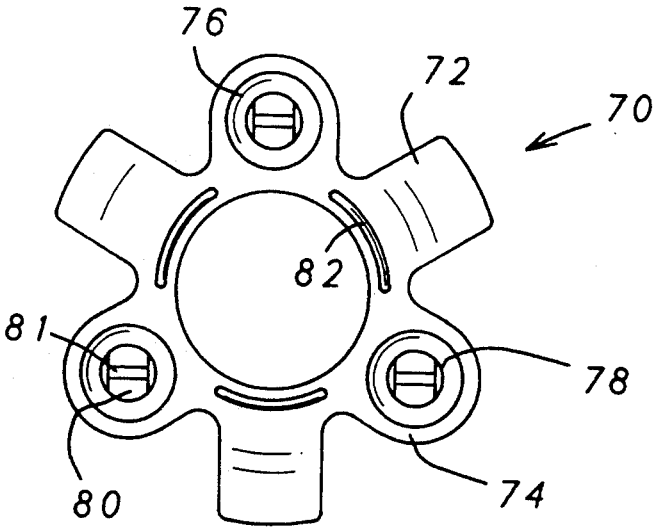

Other features of the invention and advantages afforded thereby will be evident from the remaining Claims and also from the following, detailed description of an exemplifying embodiment of the invention made with reference to the accompanying drawing, in which FIG. 1 illustrates partially in longitudinal section part of an air motor provided with an inventive valve assembly;

FIG. 2 illustrates one valve unit of the valve assembly from above and in larger scale; and FIG. 3 illustrates a second valve unit of the valve assembly, said view being taken from above similar to the view shown in FIG. 2.

In the FIG. 1 embodiment, the valve assembly is mounted in an air motor of the piston-cylinder type. However, the invention may also conceivably be applied to other types of reciprocating air motors, for instance diaphragm motors.

One end (not shown) of the air motor 10 illustrated in FIG. 1 is intended to be connected drivingly to the end of the piston rod of a liquid pump. The illustrated air motor 10 has a cylindrical housing 12 and a piston rod 14 which is guided reciprocally in said housing. A cylindrical working chamber 20 is defined in the housing 12, between an inner end wall 18 and a diameter-reducing, annular shoulder 22. The piston rod 14 is guided in the housing part 24 whose diameter is reduced by the shoulder 22, through the medium of a pair of seals 26 (only one of which is shown). Also provided in the housing part 24 is an inlet passage 16 through which working air is delivered from a source of compressed air, such as the schematically illustrated compressor 28.

Mounted on the illustrated end of the piston rod 14 is the inventive piston unit 40 with the inventive valve assembly 30. The piston unit 40 and the valve assembly 30 are produced from an elastomeric plastic material (for instance HYTREL from DUPONT) and together form only three separate components, i.e. as seen in FIG. 1, an upper valve unit 50, a lower valve unit 70 and the piston unit 40. The piston unit 40 is a one-piece structure and thus has formed integrally therewith a piston 42 and a shaft 47 which, although not shown, is provided with an external screw threaded end which is screwed firmly into the end of the piston rod 14, which is provided with a corresponding internal screw thread. Extending axially through the piston unit 40 is an outlet passage 48 which, in a known manner, continues through the piston rod 14 to transverse outlet openings (not shown) provided in the piston rod 14 and the housing part 24 beneath the seal 26, as seen in FIG. 1.

Provided in the actual piston 42 itself, which may have formed integrally with the periphery thereof a sealing lip 46, are three evenly spaced, substantially axially through-passing holes 44. The holes 44 function as guides, with clearance, for pins 78, described herebelow, and also to conduct compressed air into that part of the working chamber 20 which is located above the piston 42.

As will be seen from FIGS. 2 and 3, each of the two generally disc-like valve units 50 and 70 has roughly the shape of a star, whose points comprise alternately separate or discrete blade-spring elements 52 and 72 respectively which are curved from the flat plane of the unit, and holder tongues 54 and 74 respectively by means of which the respective valve units are connected together with the aid of the aforesaid pins 78. The three pins 78 are preferably formed integrally with the valve unit 70 and are provided at their free ends with connector heads 80 provided with spring slots 81 which enable the heads 80 to be pressed into a respective associated hole 58 in the holder tongues 54 of the upper valve units 50 so as to snap securely into the recessed back surfaces 60 of the holes 58 (FIG. 2), when the valve assembly 30 is mounted on the piston 42 (FIG. 1).

The valve units 50 and 70 also include respective valve bodies 56 and 76 in the form of lip seals which coact with the flat outer surfaces of the piston 42 around the orifices of the passages 48 and the holes 44. Each of the valve bodies 56 and 76 includes an annular, relatively soft lip which is relatively sharp-edged and which projects out from the plane of the valve unit, said lip lying against its associated planar outer surface when the valve body occupies its valve closed position. Due to this arrangement with the sealing lip in sealing engagement with a flat outer surface, the value units are able to fulfil their sealing function without being guided with the degree of accuracy necessary in earlier known arrangements of this kind.

Arranged on the valve sides of necessary disc-shaped valve units 50, 70 are bead-like projections 62 and 82. These projections 62, 82 function as spacers which hold the valve units spaced from an associated piston side in the closed position of the valve, and prevent the lips of the valve bodies 56, 76 from being deformed plastically or damaged in some other way if the valve units are subjected to heavy impact forces when the piston of said motor reaches a respective turning point. An air motor fitted with an inventive valve assembly operates in the following manner.

Compressed air is delivered continuously from the compressor 28 to the working chamber 20 of the cylinder housing 12, through the inlet passage 16 and the housing part 24 of reduced diameter. In this operational state, illustrated in FIG. 1, the valve assembly 30 is in a position in which the valve body 56 of the upper valve unit 50 is in sealing abutment with the upper surface of the piston 42 and thus closes communication between the chamber 20 and the passage 48 extending axially through the piston. In this operational state of the valve, the valve bodies 76 belonging to the valve unit 70 are held spaced from the piston by means of the pins 78, such as to keep the three through-passing holes 44 of the piston 42 open and therewith allow compressed air to flow through the annular passage defined by the play or clearance between the pins 78 and the inner surfaces of the holes 44. The pressure is herewith equalized on both sides of the piston 42. Because the upwardly projecting pressure-surface of the piston 42 is greater than its downwardly projecting pressure-surface in the working chamber 20, the piston 42 will be acted upon by a downwardly acting resultant force such as to drive the piston rod 14 downwards in the illustrated position of the valve assembly 30, relative to the piston 42.

Upon completion of this downward movement, the spring elements 72 of the lower valve unit 70 will strike against the shoulder or abutment 22 in the working chamber 20. The valve assembly 30 is therewith switched in relation to the piston 42, such that the upper valve unit 50 which includes the valve body 56 is lifted away from the upper surface of the piston 42 and opens the communication with the axial passage 48 and such that the lower valve unit, provided with the valve bodies 76, is in sealing engagement with the undersurface of the piston 42 and closes the passages through the holes 44. The space above the piston 42 is hereby ventilated to atmosphere, through the passage 48, while the pressure acts essentially unchanged on the undersurface of the piston 42, so as to cause the piston rod 14 to move upwards in the working chamber 20.

Upon completion of this upward movement of the piston rod, the spring elements 52 of the upper valve unit 50 strikes against the inner surface 18 of the cylinder end-wall and again switches the valve assembly 30 to the operational state illustrated in FIG. 1, so that the piston is again driven downwards, in the FIG. 1 illustration.

I claim:

1. A valve assembly (30) mounted on a piston unit (40) of an air motor (10) which is arranged for reciprocating movement in a housing (12), said valve assembly (30) providing the piston unit (40) with means to provide differential means surface areas such that an equalized pressure on both sides of the piston will cause movement of the piston unit (40) and comprising a first valve unit (50) which is mounted on one side of said piston unit (40) and a second valve unit (70) which is mounted on the other side of said piston unit (40), wherein said second valve unit (70) is connected with the first valve unit (50) through the medium of said piston unit (40) for common movement with said first valve unit (50) in relation to said piston unit (40) when the valve assembly (30) is switched mechanically at one of the reversing positions of the motor, to effect the reversing of the motor (10), characterized in that, each of the valve units (50 and 70 respectively) is produced from an elastomeric material and is formed integrally with discrete spring elements (52 and 72 respectively) which are adapted to strike against fixed abutments (18, 22) in the housing (12) to effect the mechanical switching of the valve assembly (30).

2. A valve assembly (30) according to claim 1, characterized in that, the valve units (50, 70) include integrally formed valve bodies (56, 76) in the form of seals which coact directly with the sides of said piston unit (40).

3. A valve assembly (30) according to claim 2, characterized in that, the valve units (50, 70) are essentially flat and the discrete spring elements are in the form of blade-spring lips (52, 72) which bend outwardly from their planes.

4. A valve assembly (30) according to claim 2, characterized in that, said piston unit (40) includes a piston (42) and a piston rod (47), which are produced integrally from an elastomeric material.

5. A valve assembly (30) according to any one of the preceding claims, characterized in that, the side of each valve unit (50, 70) which faces towards said piston (42) is provided with bead means (62, 82) which project out from the plane of said side.

* * * * *

UNITED STATES PATENT AND TRADEMARK OFFICE

CERTIFICATE OF CORRECTION

PATENT NO. : 5,203,251

DATED : April 20, 1993

INVENTOR(S) : Leif Karlberg

It is certified that error appears in the above-indentified patent and that said Letters Patent is hereby corrected as shown below:

Column 1, line 42, "semb" should be --sembly--.

Column 1, line 42, between "semb" and "in", add --having the characteristic features set forth--.

Signed and Sealed this

Fourteenth Day of December, 1993

Bruce Lehman

*Attest:*

BRUCE LEHMAN

*Attesting Officer*

*Commissioner of Patents and Trademarks*